US005925153A

United States Patent [19]

Riegel

[11] Patent Number: 5,925,153

[45] Date of Patent: Jul. 20, 1999

[54] PROCESS FOR PRODUCING FERROUS PICRATE AND A FUEL ADDITIVE CONTAINING FERROUS PICRATE

[76] Inventor: George Riegel, 10 Sauk Ct., Huntington, W. Va. 25705

[21] Appl. No.: 09/038,678

[22] Filed: Mar. 9, 1998

[51] Int. Cl.[6] ..... C10L 1/30; C07F 15/02

[52] U.S. Cl. ..... 44/367; 556/138; 556/150

[58] Field of Search ..... 556/150; 44/367

[56] References Cited

U.S. PATENT DOCUMENTS

| | | | |
|---|---|---|---|
| 4,265,639 | 5/1981 | Scholtz | 44/367 |
| 4,397,654 | 8/1983 | 'T Hart | 44/367 |
| 5,087,268 | 2/1992 | Parish | 44/312 |
| 5,359,103 | 10/1994 | Elliott et al. | 556/150 |
| 5,720,783 | 2/1998 | Elliott | 44/323 |

*Primary Examiner*—Ellen M. McAvoy
*Attorney, Agent, or Firm*—Thompson E. Fehr

[57] ABSTRACT

A process for producing ferrous picrate and a fuel additive containing ferrous picrate. Picric acid is dissolved in an organic solvent which has a low solubility for water. The resultant mixture is filtered and substantially all water is removed from the filtered mixture before an alcohol, preferably an alcohol which is not hygroscopic, is added to the filtered, dewatered mixture. Powdered elemental iron is added to the mixture that includes the alcohol; the reaction mixture resulting from the previous steps is preferably agitated until such reaction mixture becomes substantially homogeneous; and, if needed, sufficient water is added to the reaction mixture to create a conductive medium which enables the requisite ionic reaction to proceed at a reasonable rate. The concentration of water is, however, maintained below a level where the water causes the additive to be undesirably unstable. The reaction mixture is then agitated with sufficient force that large ferrous picrate molecules are moved away from unreacted iron atoms with adequate power and speed to permit picric acid molecules to reach unreacted iron atoms quickly enough to achieve a reasonable reaction rate. Preferably, before the iron is added, it is washed with an activating acid to clean its surface, with water to remove the activating acid, and with a hygroscopic alcohol to eliminate the water. Also preferably, the iron is flushed into the reaction mixture with a hygroscopic alcohol to facilitate dissolving the water in the reaction mixture.

48 Claims, No Drawings

PROCESS FOR PRODUCING FERROUS PICRATE AND A FUEL ADDITIVE CONTAINING FERROUS PICRATE

BACKGROUND OF THE INVENTION

1. Field of the Invention

This invention relates to a process for producing ferrous picrate and a fuel additive containing ferrous picrate.

2. Description of the Related Art

As stated in U.S. Pat. No. 5,087,268 of Walter W. Parish, numerous patents have been granted for processes which utilize picric acid, some form of iron, and a solvent to produce an additive for hydrocarbon fuels which increases the efficiency of the combustion of such fuels, resulting in better mileage, reduced deposits within the engine, and a smaller quantity of pollutants in the exhaust.

In the context of the present invention, U.S. Pat. No. 5,087,268 is, in fact, the most significant patent of the prior art.

The disclosure in U.S. Pat. No. 5,087,268 observes that stability is enhanced because the process of that patent does not require the use of water; however, U.S. Pat. No. 5,087,268 does not otherwise explicitly consider controlling the concentration of water which is present in the reaction mixture. And not only is water always introduced with picric acid since picric acid is universally contained within water for shipment because dry picric acid is explosive; but all of the activating acids used in the process of U.S. Pat. No. 5,087,268 to remove any substances from the surface of the iron to expose a surface of pure iron are solutions of the activating acid in water and, therefore, introduce water when included within the reaction mixture.

Furthermore, the present inventor has learned that difficulties are generated for the fuel additive by too little water, as well as by too much water. A concentration of water which is too high causes the ferrous picrate and the fuel additive to degrade over a relatively short period of time; and a concentration of water which is too low substantially increases the time required to produce the ferrous picrate and the fuel additive.

A similar situation exists, moreover, with respect to nitrates and sulfates. U.S. Pat. No. 5,087,268 correctly observed that not requiring sulfates in its process enhanced the stability of the ferrous picrate fuel additive. Again, however, other than not using sulfates in its process, U.S. Pat. No. 5,087,268 did not explicitly provide any technique for controlling the presence of sulfates and did not even mention nitrates, which also have a negative effect upon the stability of the fuel additive, except for the comment that nitric acid caused instability in the additive.

Finally, U.S. Pat. No. 5,087,268 simply refers to agitation of powdered elemental iron. But the inventor of the present process has discovered that the reaction of picric acid with the iron metal is a surface phenomenon. Therefore, because a molecule of picric acid is very large in comparison to an atom of iron (The molecular volume of picric acid is 129.95; the molecular volume of iron, 7.11.), once an atom of iron has combined with two molecules of picric acid, a molecule of ferrous picrate, which is even larger than the picric acid molecule, exists on the surface of the collection of iron atoms and, by its shear size precludes other molecules of picric acid from reacting with iron atoms that are in the vicinity of the one iron atom which has already reacted. Furthermore, ferrous picrate is ionic and, thus, a polar molecule exhibiting magnetic properties. Since an atom of iron is magnetic, a polar ferrous picrate molecule will be magnetically attracted to iron atoms. Consequently, mere agitation does not create adequate force to move the ferrous picrate molecules away from the unreacted iron molecules; to achieve a reasonable reaction rate, a ball mill must be employed.

SUMMARY OF THE INVENTION

The present invention improves the reaction rate achieved by the process of U.S. Pat. No. 5,087,268 and the stability of the ferrous picrate fuel additive produced by that process. (Stability is essential since the reactions associated with deterioration deprive the fuel additive of its ability to increase the efficiency of the combustion of the fuel to which it has been added and, therefore, to produce better mileage, reduce deposits within the engine burning the fuel and additive, and to generate a smaller quantity of pollutants in the exhaust from the engine.)

Three techniques are utilized to achieve these improvements.

Since picric acid is prepared from nitric acid and sulfuric acid, residual nitrates and sulfates, which degrade the stability of the ferrous picrate fuel additive, are virtually always present with picric acid. Such residual nitrates and sulfates are, in the process of the present invention, removed by filtration and an initial elimination of water from the reaction mixture.

Subsequently, water is added to the reaction mixture; but the concentration of water in the reaction mixture is carefully controlled to optimize both the reaction rate and the stability of the resultant ferrous picrate fuel additive.

And the reaction mixture is agitated with sufficient force that large ferrous picrate molecules are moved away from unreacted iron atoms with adequate power and speed to permit picric acid molecules to reach unreacted iron atoms quickly enough to achieve a reasonable reaction rate.

DESCRIPTION OF THE PREFERRED EMBODIMENT

Picric acid is first dissolved in an organic solvent. The organic solvent may be any such solvent in which picric acid is soluble and which has a low solubility for water. For example, the solvent may be xylene, toluene, trimethyl benzene, Hi-Sol 10, tetramethyl benzene, or Hi-Sol 15. No alcohol may, however, be present when the picric acid is added because water is soluble in alcohol and could not be removed were it to enter into such a solution.

Both soluble and insoluble nitrates and sulfates are associated with the picric acid; and, if these nitrates and sulfates are not removed, such nitrates and sulfates cause stability problems, as discussed above, for the resultant fuel additive. To eliminate the insoluble nitrates and sulfates (which are primarily those associated with heavy metals), the second step of the present process is removal of such compounds and insoluble residual sulfates by filtration.

Thirdly, to improve the stability of the fuel additive further, substantially all water is removed, preferably by decantation. This, of course, also removes those nitrates and sulfates that are soluble in water (which are principally, those associated with light metals, such as sodium and potassium) and that are, consequently, dissolved in the water phase.

The fourth step is the addition of any alcohol. Representative examples are cyclic, branched, and straight chain alkanols, including methanol, ethanol, propanol, isopropanol, butanols, pentanols, hexanols, octanols, ethylhexanol, and cyclohexanol. Preferred alcohols are, however, those which are not hygroscopic, i.e., those alcohols which do not demonstrate a marked affinity for water and, consequently, do not absorb water from the air. The utilization of an alcohol that is not hygroscopic, thus, prevents the fuel additive from degrading as a result of excess water which has been introduced from the atmosphere.

The purpose of the alcohol is to dissolve the ferrous picrate which is formed. Ferrous picrate is a polar molecule, but the molecules of the organic solvents are not polar. Therefore, the ferrous picrate which forms is not soluble in the organic solvent. The alcohols are, however, polar. They can, thus, be used individually or can be combined in the reaction mixture.

All alcohols less than $C_4$, i.e., all alcohols below butanol—e.g., ethanol, methanol, and the propanols—are hygroscopic. Alcohols equal to or greater than $C_4$ are generally not hygroscopic, e.g., butanol, pentanol, hexanol, octanol, and cyclohexanol.

The fifth step in the process of the present invention is the addition of powdered elemental iron since using powdered elemental iron will increase the surface area of the iron and, therefore, also accelerate the reaction rate.

Before the iron is added, however, such iron preferably has its surface cleaned to expose (or activate) a surface of pure iron. The iron is washed with an activating acid which reacts with the surface of the iron to remove any substances other than iron from the surface of the iron. To assure that no acid enters into the fuel additive, the iron is next washed with water; this is preferably done three times. Finally, to remove any water that remains with the iron, the iron is washed with any hygroscopic alcohol.

The activating acid can be hydrochloric, formic, acetic, propionic, chloroacetic, succinic, perchloric, oxalic, malonic, glutaric, adipic, maleic, citric, glycolic, diglycolic, sulfamic, butyric, trifluoroacetic, acrylic, methacrylic, crotonic, ethylenediamine tetraacetic, diethylenetriamine pentaacetic, or senecioic acid.

Hygroscopic alcohol is preferably added with the powdered elemental iron, to flush the iron into the reaction mixture. Preferably, the total of the hygroscopic alcohol which is used to wash the iron and that is introduced into the reaction mixture with the iron is 4 ounces per 55 gallons of reaction mixture.

At this point in the process, the reaction mixture resulting from the previous steps tends to involve three components within the reaction vessel, preferably a ball mill. These components are the mixture of picric acid in the organic solvent, the—preferably, non-hygroscopic—alcohol that was added to the mixture of picric acid in the organic solvent, and the iron with the hygroscopic alcohol. All three of these components are soluble in one another, but to this point in the process, the components may not have mixed with one another enough to create a reaction mixture that is substantially homogeneous.

As a preferable sixth step, therefore, the reaction mixture is briefly agitated, preferably by activating the ball mill and preferably for approximately five minutes, to cause all the components to meld into a substantially homogeneous mixture from which a representative sample can be taken. (The ball mill utilized by the present inventor has simply been a 55-gallon drum placed on rollers and containing zirconium tablets.)

A representative sample of the then substantially homogeneous reaction mixture is then preferably taken and analyzed for water content.

Since the reaction between the iron and the picric acid by which the ferrous picrate is formed is an ionic reaction, this desired reaction can take place only in a conductive medium through which two electrons can flow from the unreacted iron atom to two picric acid molecules to create a ferrous picrate molecule composed of ionic iron and an ionic picrate radical. And the seventh step in the process of producing the ferrous picrate and, consequently, the ferrous picrate fuel additive, viz., the addition of water to the, preferably substantially homogeneous, reaction mixture, creates such a conductive medium.

The hygroscopic alcohol is also preferably used since it facilitates dissolving water in the organic solvent and higher non-hygroscopic alcohols to create a sufficiently conducting medium that the rate of the reaction will be reasonable.

To create such a suitably conductive medium and produce a reasonable reaction rate, the concentration of water within the reaction mixture must be greater than 600 parts per million (ppm) in order to avoid having the reaction require excessive time to occur. A preferred range for the concentration of water is 800 ppm to 1600 ppm. At any concentration greater than 1600 ppm, the ferrous picrate fuel additive is unstable. And it has been experimentally determined that a concentration of 800 ppm to 900 ppm of water in the reaction mixture is most preferable. Generally, achieving a concentration of 800 ppm to 900 ppm of water in the reaction mixture requires adding 40 to 50 milliliters of water to 55 gallons of reaction mixture.

Utilizing just 4 ounces of hygroscopic alcohol per 55 gallons of reaction mixture assures that the hygroscopic alcohol will be unable to absorb sufficient water from the atmosphere to cause the fuel additive to degrade.

The eighth, and final step, is agitating the reaction mixture with sufficient force that large ferrous picrate molecules are moved away from unreacted iron atoms with adequate power and speed to permit picric acid molecules to reach unreacted iron atoms quickly enough to achieve a reasonable reaction rate. This is preferably done by reactivating a ball mill within which the reaction mixture is located, and such agitation preferably is performed for 25 to 50 minutes.

Besides a ball mill, other examples of devices which can produce the requisite agitation are a shearing impeller placed on a regular stirrer to create high forces within the reaction mixture; dispersion blades produced by Indco of New Albany, Ind.; and dispersers/homogenizers manufactured by Kinematico, Inc. of Cincinnati, Ohio, although such dispersers/homogenizers require a faster stirrer since their tip speed is critical for creating the requisite agitation.

The ferrous picrate fuel additive produced through the process of the present invention has remained stable for more than two years.

In order to accelerate the deterioration of ferrous picrate fuel additive several samples of such additives were prepared by various methods and stored at a temperature of 60° C. The rate of deterioration does not vary linearly with temperature, but it has experimentally been observed that the faster a sample deteriorates at 60° C., the faster it will deteriorate at lower temperatures.

Examples of the deterioration are as follows:

EXAMPLE 1

A 100 milliliter sample of ferrous picrate fuel additive was produced by the process of U.S. Pat. No. 5,087,268 deteriorated in approximately three days at the elevated temperature. Analysis showed that the concentration of water in the additive was 1,345 parts per million.

EXAMPLE 2

A 100 milliliter sample of ferrous picrate fuel additive was produced by dissolving 2.7 grams of picric acid in 85 milliliters of Hi-Sol 10, then adding 15 milliliters of butanol, and finally including 0.029 grams of activated iron. The resultant reaction mixture was stirred until all the iron had reacted. No water was removed from the additive. Deterioration occurred in two days at the elevated temperature. The concentration of water in the additive was 2,400 parts per million.

EXAMPLE 3

A 100 milliliter sample of ferrous picrate fuel additive was produced by the same process as described in Example 2, above, except that after the picric acid had been dissolved in the Hi-Sol 10 and before the butanol was added, water was decanted. Deterioration required 19 days at the elevated temperature, and the concentration of water in the additive was 837 parts per million.

EXAMPLE 4

A 100 milliliter sample of ferrous picrate fuel additive was produced by using the preferred ball mill and process of the present invention. The additive deteriorated in 17 days at the elevated temperature, and the concentration of water in the additive was 825 parts per million.

I claim:

1. A process for producing ferrous picrate and a fuel additive containing ferrous picrate, which comprises:

dissolving picric acid in an organic solvent which has a low solubility for water;

filtering the resultant mixture;

removing substantially all water from the filtered mixture;

adding an alcohol to the filtered, dewatered mixture;

adding powdered elemental iron to the mixture that includes the alcohol;

adding water to the reaction mixture in order to create a suitably conductive medium; and agitating the reaction mixture with sufficient force that large ferrous picrate molecules are moved away from unreacted iron atoms with adequate power and speed to permit picric acid molecules to reach unreacted iron atoms quickly enough to achieve a reasonable reaction rate.

2. The process for producing ferrous picrate and a fuel additive containing ferrous picrate as recited in claim 1, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

3. The process for producing ferrous picrate and a fuel additive containing ferrous picrate as recited in claim 1, further comprising:

adding hygroscopic alcohol with the powdered elemental iron to flush the iron into the reaction mixture and to facilitate dissolving the water in the reaction mixture.

4. The process for producing ferrous picrate and a fuel additive containing ferrous picrate as recited in claim 3, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

5. The process for producing ferrous picrate and a fuel additive containing ferrous picrate as recited in claim 3, wherein:

the alcohol which is added to the filtered, dewatered mixture is an alcohol selected from the group consisting of cyclic, branched, and straight chain alkanols, including methanol, ethanol, propanol, isopropanol, butanols, pentanols, hexanols, octanols, ethylhexanol, and cyclohexanol.

6. The process for producing ferrous picrate and a fuel additive containing ferrous picrate as recited in claim 5, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

7. The process for producing ferrous picrate and a fuel additive containing ferrous picrate as recited in claim 5, further comprising:

after adding the powdered elemental iron but before adding water to the reaction mixture, agitating the reaction mixture resulting from the previous steps until such reaction mixture becomes substantially homogeneous; and analyzing the substantially homogeneous reaction mixture to determine the water content of such substantially homogeneous reaction mixture.

8. The process for producing ferrous picrate and a fuel additive containing ferrous picrate as recited in claim 7, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

9. The process for producing ferrous picrate and a fuel additive containing ferrous picrate as recited in claim 7, wherein:

the quantity of water which is added to the substantially homogeneous reaction mixture is that quantity which creates a concentration of 800 parts per million to 1600 parts per million of water in the substantially homogeneous reaction mixture.

10. The process for producing ferrous picrate and a fuel additive containing ferrous picrate as recited in claim 9, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

11. The process for producing ferrous picrate and a fuel additive containing ferrous picrate as recited in claim 5, wherein:

the quantity of water which is added to the substantially homogeneous reaction mixture is that quantity which creates a concentration of 800 parts per million to 1600 parts per million of water in the substantially homogeneous reaction mixture.

12. The process for producing ferrous picrate and a fuel additive containing ferrous picrate as recited in claim 11, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

13. The process for producing ferrous picrate and a fuel additive containing ferrous picrate as recited in claim 3, wherein:

the alcohol which is added to the filtered, dewatered mixture is not hygroscopic.

14. The process for producing ferrous picrate and a fuel additive containing ferrous picrate as recited in claim 13, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

15. The process for producing ferrous picrate and a fuel additive containing ferrous picrate as recited in claim 13, further comprising:

after adding the powdered elemental iron but before adding water to the reaction mixture, agitating the reaction mixture resulting from the previous steps until such reaction mixture becomes substantially homogeneous; and analyzing the substantially homogeneous reaction mixture to determine the water content of such substantially homogeneous reaction mixture.

16. The process for producing ferrous picrate and a fuel additive containing ferrous picrate as recited in claim 15, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

17. The process for producing ferrous picrate and a fuel additive containing ferrous picrate as recited in claim 15, wherein:

the quantity of water which is added to the substantially homogeneous reaction mixture is that quantity which creates a concentration of 800 parts per million to 1600 parts per million of water in the substantially homogeneous reaction mixture.

18. The process for producing ferrous picrate and a fuel additive containing ferrous picrate as recited in claim 17, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

19. The process for producing ferrous picrate and a fuel additive containing ferrous picrate as recited in claim 13, wherein:

the quantity of water which is added to the substantially homogeneous reaction mixture is that quantity which creates a concentration of 800 parts per million to 1600 parts per million of water in the substantially homogeneous reaction mixture.

20. The process for producing ferrous picrate and a fuel additive containing ferrous picrate as recited in claim 19, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

21. The process for producing ferrous picrate and a fuel additive containing ferrous picrate as recited in claim 3, further comprising:

after adding the powdered elemental iron but before adding water to the reaction mixture, agitating the reaction mixture resulting from the previous steps until such reaction mixture becomes substantially homogeneous; and analyzing the substantially homogeneous reaction mixture to determine the water content of such substantially homogeneous reaction mixture.

22. The process for producing ferrous picrate and a fuel additive containing ferrous picrate as recited in claim 21, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

23. The process for producing ferrous picrate and a fuel additive containing ferrous picrate as recited in claim 21, wherein:

the quantity of water which is added to the substantially homogeneous reaction mixture is that quantity which creates a concentration of 800 parts per million to 1600 parts per million of water in the substantially homogeneous reaction mixture.

24. The process for producing ferrous picrate and a fuel additive containing ferrous picrate as recited in claim 23, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

25. The process for producing ferrous picrate and a fuel additive containing ferrous picrate as recited in claim 3, wherein:

the quantity of water which is added to the substantially homogeneous reaction mixture is that quantity which creates a concentration of 800 parts per million to 1600 parts per million of water in the substantially homogeneous reaction mixture.

26. The process for producing ferrous picrate and a fuel additive containing ferrous picrate as recited in claim 25, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

27. The process for producing ferrous picrate and a fuel additive containing ferrous picrate as recited in claim 1, wherein:

the alcohol which is added to the filtered, dewatered mixture is an alcohol selected from the group consisting of cyclic, branched, and straight chain alkanols, including methanol, ethanol, propanol, isopropanol, butanols, pentanols, hexanols, octanols, ethylhexanol, and cyclohexanol.

28. The process for producing ferrous picrate and a fuel additive containing ferrous picrate as recited in claim 27, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

29. The process for producing ferrous picrate and a fuel additive containing ferrous picrate as recited in claim 27, further comprising:

after adding the powdered elemental iron but before adding water to the reaction mixture, agitating the reaction mixture resulting from the previous steps until such reaction mixture becomes substantially homogeneous; and analyzing the substantially homogeneous reaction mixture to determine the water content of such substantially homogeneous reaction mixture.

30. The process for producing ferrous picrate and a fuel additive containing ferrous picrate as recited in claim 29, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

31. The process for producing ferrous picrate and a fuel additive containing ferrous picrate as recited in claim 29, wherein:

the quantity of water which is added to the substantially homogeneous reaction mixture is that quantity which creates a concentration of 800 parts per million to 1600 parts per million of water in the substantially homogeneous reaction mixture.

32. The process for producing ferrous picrate and a fuel additive containing ferrous picrate as recited in claim 31, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

33. The process for producing ferrous picrate and a fuel additive containing ferrous picrate as recited in claim 27, wherein:

the quantity of water which is added to the substantially homogeneous reaction mixture is that quantity which creates a concentration of 800 parts per million to 1600 parts per million of water in the substantially homogeneous reaction mixture.

34. The process for producing ferrous picrate and a fuel additive containing ferrous picrate as recited in claim 33, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

35. The process for producing ferrous picrate and a fuel additive containing ferrous picrate as recited in claim 1, wherein:

the alcohol which is added to the filtered, dewatered mixture is not hygroscopic.

36. The process for producing ferrous picrate and a fuel additive containing ferrous picrate as recited in claim 35, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

37. The process for producing ferrous picrate and a fuel additive containing ferrous picrate as recited in claim 35, further comprising:

after adding the powdered elemental iron but before adding water to the reaction mixture, agitating the reaction mixture resulting from the previous steps until such reaction mixture becomes substantially homogeneous; and analyzing the substantially homogeneous reaction mixture to determine the water content of such substantially homogeneous reaction mixture.

38. The process for producing ferrous picrate and a fuel additive containing ferrous picrate as recited in claim 37, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

39. The process for producing ferrous picrate and a fuel additive containing ferrous picrate as recited in claim 37, wherein:

the quantity of water which is added to the substantially homogeneous reaction mixture is that quantity which creates a concentration of 800 parts per million to 1600 parts per million of water in the substantially homogeneous reaction mixture.

40. The process for producing ferrous picrate and a fuel additive containing ferrous picrate as recited in claim 39, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

41. The process for producing ferrous picrate and a fuel additive containing ferrous picrate as recited in claim 35, wherein:

the quantity of water which is added to the substantially homogeneous reaction mixture is that quantity which creates a concentration of 800 parts per million to 1600 parts per million of water in the substantially homogeneous reaction mixture.

42. The process for producing ferrous picrate and a fuel additive containing ferrous picrate as recited in claim 41, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

43. The process for producing ferrous picrate and a fuel additive containing ferrous picrate as recited in claim 1, further comprising:

after adding the powdered elemental iron but before adding water to the reaction mixture, agitating the reaction mixture resulting from the previous steps until such reaction mixture becomes substantially homogeneous; and analyzing the substantially homogeneous reaction mixture to determine the water content of such substantially homogeneous reaction mixture.

44. The process for producing ferrous picrate and a fuel additive containing ferrous picrate as recited in claim 43, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

45. The process for producing ferrous picrate and a fuel additive containing ferrous picrate as recited in claim 43, wherein:

the quantity of water which is added to the substantially homogeneous reaction mixture is that quantity which creates a concentration of 800 parts per million to 1600 parts per million of water in the substantially homogeneous reaction mixture.

46. The process for producing ferrous picrate and a fuel additive containing ferrous picrate as recited in claim 45, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

47. The process for producing ferrous picrate and a fuel additive containing ferrous picrate as recited in claim 1, wherein:

the quantity of water which is added to the substantially homogeneous reaction mixture is that quantity which creates a concentration of 800 parts per million to 1600 parts per million of water in the substantially homogeneous reaction mixture.

48. The process for producing ferrous picrate and a fuel additive containing ferrous picrate as recited in claim 47, further comprising:

before adding the powdered elemental iron to the mixture that includes the alcohol, washing the powdered elemental iron with an activating acid;

then washing the activated powdered elemental iron with water to assure that the activating acid is removed; and then washing the activated powdered elemental iron with a hygroscopic alcohol to remove any water from the iron.

* * * * *